US006431918B1

(12) United States Patent
Givens et al.

(10) Patent No.: US 6,431,918 B1
(45) Date of Patent: Aug. 13, 2002

(54) MODULAR JACK CONNECTOR MEETING 1000BASE-T SPECIFICATIONS

(75) Inventors: David Frederick Givens, Red Lion; Leonard K. Espenshade, Harrisburg, both of PA (US)

(73) Assignee: Hon Hai Precisionind. Co., Ltd., Taipei Hsiena (TW)

( * ) Notice: Subject to any disclaimer, the term of this patent is extended or adjusted under 35 U.S.C. 154(b) by 0 days.

(21) Appl. No.: 09/844,556

(22) Filed: Apr. 27, 2001

(51) Int. Cl.[7] ..... H01R 23/02
(52) U.S. Cl. ..... 439/676
(58) Field of Search ..... 439/676, 941, 439/607, 76.1

(56) References Cited

U.S. PATENT DOCUMENTS 5,567,167 A * 10/1996 Hayashi ..... 439/65
5,759,067 A * 6/1998 Scheer ..... 439/607
6,186,836 B1 * 2/2001 Ezawa et al. ..... 439/676
6,328,595 B1 * 12/2001 Chang ..... 439/490

* cited by examiner

*Primary Examiner*—Brian Sircus
*Assistant Examiner*—Phuong Dinh
(74) *Attorney, Agent, or Firm*—Wei Te Chung

(57) ABSTRACT

A modular jack connector comprises an insulative housing (1) and an insert module (2) received in the insulative housing. The insert module includes an insert (20) having contacts (24) retained therein, a cross talk compensating printed circuit board (21), and a footer (22) having terminals (26) retained therein. Both the contacts and terminals have press-fit eyelet portions (243, 261) for facilitating assembly to the printed circuit board. The contacts of the insert are configured as four differential pairs having a pairing of ①②-③④-⑤⑥-⑦⑧, wherein the ①② and ③④ pairs are used for signal transmission, and the ⑤⑥ and ⑦⑧ pairs are used for signal reception. The contacts have intermediate portions (242) arranged on upper and lower levels.

12 Claims, 9 Drawing Sheets

| TABLE 1<br>Contact Arrangement for 1000Base-T (Category 5) | | |
|---|---|---|
| Contact Position | Utilization | Pairing |
| ① | TP1(+) | Pair 1 |
| ② | TP1(-) | |
| ③ | TP2(+) | Pair 2 |
| ④ | TP2(-) | |
| ⑤ | RP1(+) | Pair 3 |
| ⑥ | RP1(-) | |
| ⑦ | RP2(+) | Pair 4 |
| ⑧ | RP2(-) | |

FIG. 9

| TABLE 2<br>NEXT Loss at 100Mhz | | |
|---|---|---|
| Aggressor Pair | Victim Pair | NEXT(dB) |
| 1 | 2 | -54.08 |
| 1 | 3 | -56.28 |
| 1 | 4 | -72.68 |
| 2 | 3 | -48.65 |
| 2 | 4 | -51.47 |
| 3 | 4 | -48.17 |

FIG. 10

TABLE 3

Contact Arrangement for 100Base-T (Category 5)

| Contact Position | Utilization | Pairing |
|---|---|---|
| 1 | TP1(+) | Pair 1 |
| 2 | TP1(-) | |
| 3 | RP(+) | Pair 2 |
| 4 | Unused | |
| 5 | Unused | |
| 6 | RP(-) | |
| 7 | Unused | |
| 8 | Unused | |

FIG. 11
(PRIOR ART)

MODULAR JACK CONNECTOR MEETING 1000BASE-T SPECIFICATIONS

BACKGROUND OF THE INVENTION

1. Field of the Invention

The present invention relates to a modular jack connector, and particularly to a modular jack connector optimized for 1000Base-T transmission and operating in a Category 5 cable environment.

2. Description of Related Art

Modular jack connectors have been used for more than 30 years in communications industry, originally to connect telephones to telephone lines. As technology has advanced, modular jack connectors have been adapted to keep pace with emerging needs. However, modular jack connectors are for use with copper wire cabling networks, which are rapidly becoming obsolete.

In communication networks today, the bulk of communication lines are still copper wire cables. This is particularly true in older buildings. The trend in communication technology is toward the use of fiber optic cables, which provide greater bandwidth and other benefits. Conversion of present copper wire communication networks to fiber optic networks promises to be very expensive, as it will require replacing copper wire cabling in buildings with fiber optic cabling.

Communication cabling networks are classified into different categories according to different performances delivered. Most copper wire cabling networks presently in use, together with their connectors, fall into Category 5, which have already replaced Category 3 systems. Category 5 has much more demanding requirements and delivers far greater performance. One benchmark for Category 5 performance is that NEXT (near end cross talk) be lower than −40 dB at 100 MHz (megahertz). Category 5E, or Enhanced Category 5, was developed after Category 5 to provide stricter control over the Category 5 electrical environment. However, the bandwidth is still 100 MHz. Category 6, which is as yet undefined formally by the EIA (Electronic Industries Association), is more demanding, and has been promoted in a few European countries where the expense and precision are deemed justifiable.

As demands on networks using four pair UTP (unshielded twisted-pair) wiring systems, such as transmission rates, have increased, development of industry standards has been forced to higher system performance. The Category 5 level performance defines electrical parameters for proper data signal systems that require up to 100 MHz frequency bandwidth, i.e., fast Ethernet 100Base-T. The latest data rates have increased up to 250 Mbps (mega-bits per second), i.e., 1000Base-T Ethernet, which allow LAN (local area network) systems to transfer data 10 times faster than 100BaseT Ethernet on UTP media cabling.

As applications become more bandwidth hungry, users are approaching a point at which outdated copper wiring will have to be replaced by fiber optics, which will be a great expense, especially in old buildings. If connectors can be devised to use presently existing wires in these old buildings to deliver Category 5 performance in 1000Base-T networks, the urgency for homes and businesses to make expensive change from copper wire cabling to fiber optics may be lessened, saving users a great deal of money.

However, presently available Category 5 arrangements yield a margined modular jack connector that fails to achieve satisfactory performance when utilized under the 1000Base-T Ethernet, or Gigabit Ethernet protocol, in despite of Category 5 connectors being called out in the specification. Present network installations generally use Category 5 UTP wiring and hardware that support the 100Base-T standard with two pairs of Category 5 UTP or STP (shielded twisted-pair) wire. In the 100Base-T scheme, one twisted pair (the ①-② pair) is used for signal transmission, a second pair (the ③-⑥ pair) is used for signal reception, and the remaining two pairs (the ④-⑤ and ⑦-⑧ pairs) are unused. Correspondingly, as illustrated in FIG. 11, the modular jack connector for use with Category 5 copper wire cabling networks supporting the 100Base-T standard has 8 contacts arranged in the same manner. Such an arrangement is suitable for 100Base-T networks. Typically, the ③-⑥ and ④-⑤ pairs are constructed as straddled pairs which cause electrical problems. In order to meet the cross talk requirements, many designs for modular jack connectors address this problem by shifting or crossing over wires. In doing so, electrical performance for 1000Base-T will be severely and negatively affected. In addition, forcing the system to drive signals through the straddled pairs ③-⑥ and ④-⑤ will have detrimental effects on the data. Moreover, the ④-⑤ and ⑦-⑧ pairs that are not used in the jack are open circuited, thus increasing cross talk. As a result, the use of current standard Category 5 connectors actually degrades the system performance below Category 5 in the majority of cases.

As is well known in the art, present modular jack connectors comprise a rectangular housing defining a cavity therein, a dielectric insert retained within the cavity, a plurality of contacts molded into the insert, and a printed circuit board assembled vertically to a rear of the housing. One problem with the present modular jack connector is that a rearward end of each contact often terminates in a pin which inserts through a through hole defined in the printed circuit board and requires soldering therein, which is inconvenient to assemble.

Accordingly, what is desired is a modular jack connector, optimized for 1000Base-T, for use with presently existing copper wire cabling, which will allow Category 5 performance in these old copper wire communication networks. Such a modular jack connector meeting Category 5 performance standards and permitting easy and inexpensive assembling is also desired. When this modular jack connector is used in conjunction with the 1000BaseT protocol, a 4-fold improvement in data transmission is achieved over 100Base-T, thus extending the useful life of the copper network. This will call for a new wiring scheme in the modular jack on 1000Base-T systems and, finally, provide adequate electrical performance for system manufacturers to successfully promote this new standard to mainstream applications.

SUMMARY OF THE INVENTION

Accordingly, one objective of the present invention is to provide a modular jack connector that yields Category 5 performance in a copper wire network optimized for operation under the 1000Base-T protocol.

A second objective of the present invention is to provide a modular jack connector that yields Category 5 performance in a copper wire network, which is easy to assemble.

A third objective of the present invention is to provide a modular jack connector which yields Category 5 performance in a copper wire network, which is inexpensive to manufacture.

In order to achieve the objects set forth, a modular jack connector of the present invention comprises an insulative housing, an insert module received in the insulative housing, and a shield enclosing the insulative housing. The insert module includes an insert having an insulative body and a plurality of contacts retained in the insulative body, a printed circuit board vertically assembled to the rear of the insert, and a footer assembled to the rear of the printed circuit board and having a plurality of terminals retained therein.

The printed circuit board defines an upper array and a lower array of plated through holes interconnected with each other via conductive traces therebetween. The contacts of the insert include inclined mating portions for mating with corresponding contacts of a complementary plug connector, intermediate portions retained in the insulative body, and tail portions in the form of press-fit eyelet portions for being press fitted into the upper array of plated through holes of the printed circuit board. The terminals of the footer also include press-fit eyelet portions for being press fitted into the lower array of the printed circuit board. An electrical path is thus established within the insert module through the contacts of the insert, the plated through holes and conductive traces of the printed circuit board, and the terminals of the footer. Assembly and disassembly of the insert module are facilitated due to the provision of the press-fit eyelet portions of the contacts and the terminals of the respective insert and footer.

To yield Category 5 performance in a copper wire network optimized for 1000Base-T applications, the contacts of the insert are configured as 4 differential pairs all used for transmitting and receiving signals, wherein ①② is a first pair for signal transmission, ③④ is a second pair for signal transmission, ⑤⑥ is a third pair for signal reception and ⑦⑧ is a fourth pair for signal reception. The intermediate portions of the contacts are arranged on two levels, wherein those of the ③④ and ⑦⑧ pairs are arranged on an upper level and those of the ①② and ⑤⑥ pairs are arranged on a lower level. To reduce the cross talk induced between the contacts during engagement with the complementary plug connector, the distance between the intermediate portions of each pair is minimized and the distance between adjacent pairs on the same level is maximized. The printed circuit board, which functions as a cross talk compensating circuit board, also aids in meeting the 1000Base-T specifications by adding inter-digital compensation therein.

Other objects, advantages and novel features of the invention will become more apparent from the following detailed description when taken in conjunction with the accompanying drawings.

BRIEF DESCRIPTION OF THE DRAWINGS

FIG. 9 is a table showing the contact arrangement of the present invention optimized for 1000Base-T applications;

FIG. 10 is a table showing the NEXT losses at 100 MHz induced between pairs of the contact array of the present invention; and FIG. 11 is a table showing the conventional contact arrangement for 100Base-T applications.

DETAILED DESCRIPTION OF THE INVENTION

Figure 1:
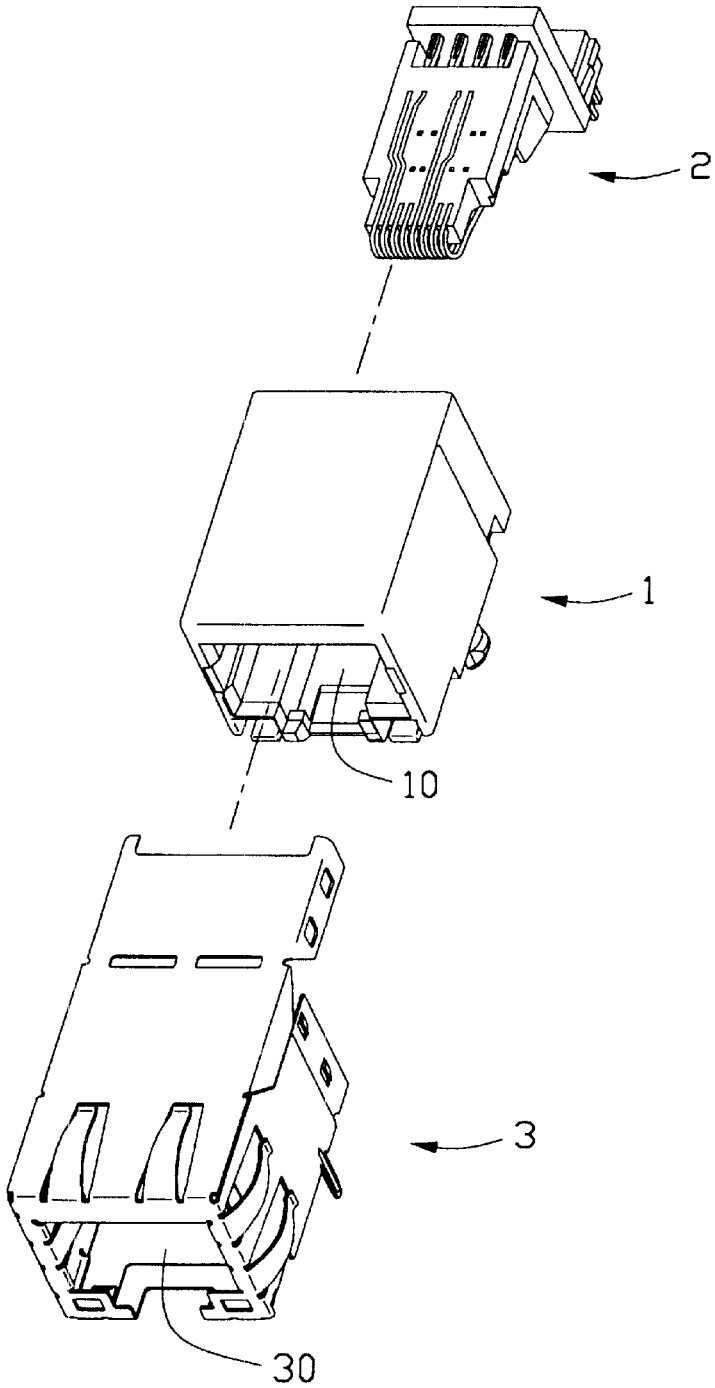
FIG. 1 is an exploded perspective view of a modular jack connector in accordance with the present invention.

Reference will now be made to the drawing figures to describe the present invention in detail.

Figure 2:
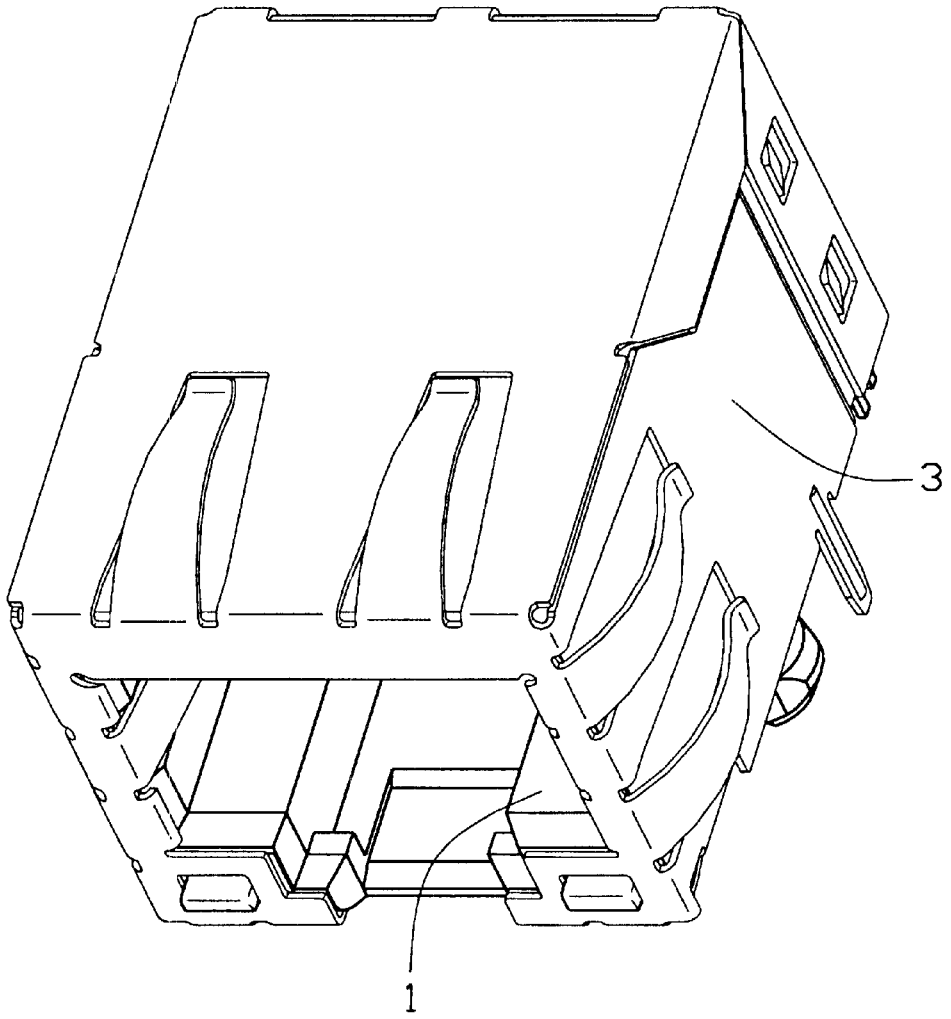
FIG. 2 is an assembled view of FIG. 1.

Referring to FIGS. 1 and 2, a modular jack connector in accordance with the present invention comprises a rectangular insulative housing 1 defining a cavity 10 therein, an insert module 2 retained within the cavity 10, and a shield 3 enclosing the insulative housing 1 with an opening 30 defined in a front surface thereof in communication with the cavity 10 of the insulative housing 1 for receiving a complementary plug connector (not shown).

Figure 3:
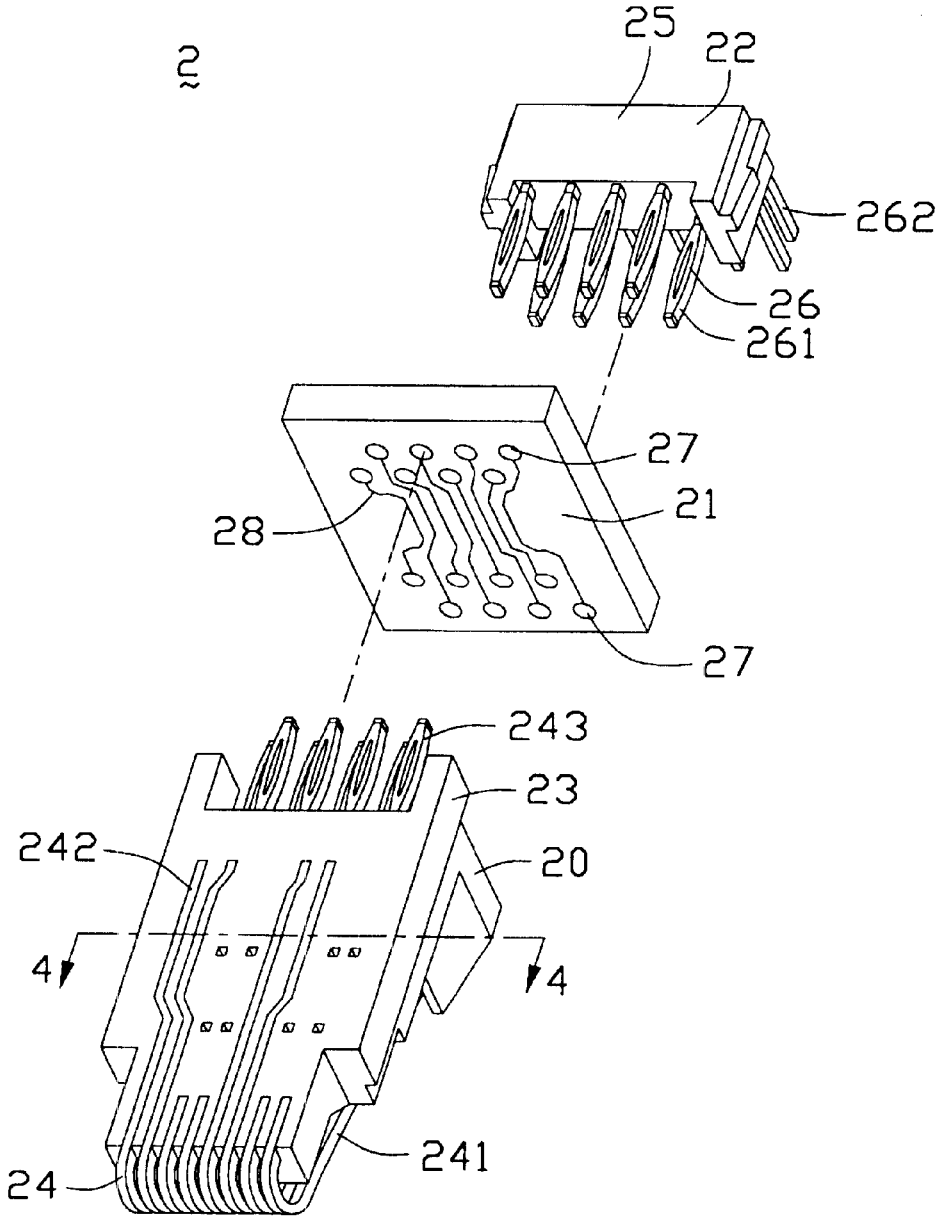
FIG. 3 is an exploded perspective view of an insert module shown in FIG. 1.
Figure 4:
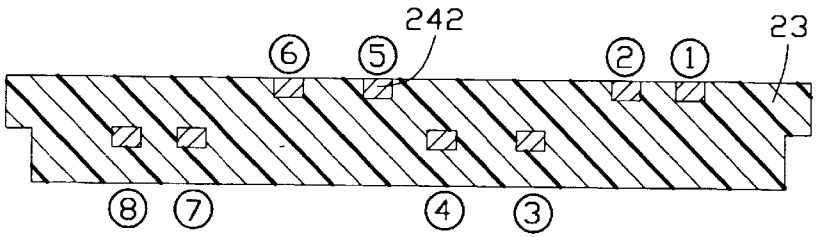
FIG. 4 is a cross-sectional view taken along line 4—4 of FIG. 3.
Figure 5:
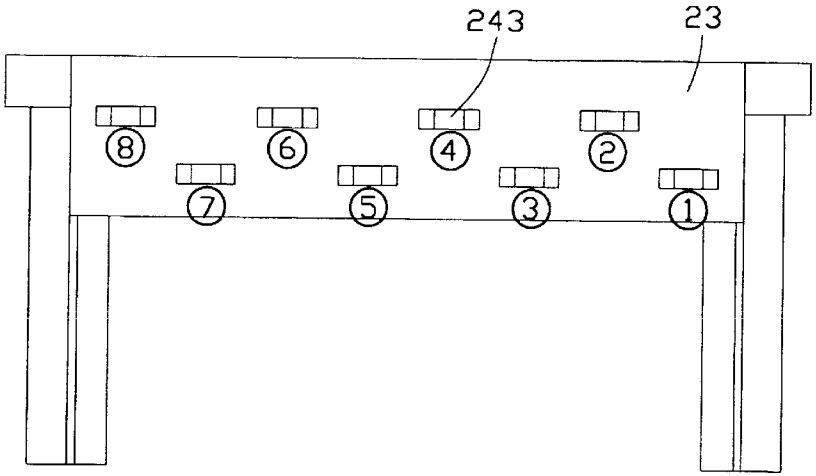
FIG. 5 is a rear view of an insert shown in FIG. 3.

As is shown in FIG. 3, the insert module 2 includes an insert 20 having an insulative body 23 and a plurality of contacts 24 molded in the insulative body 23, a printed circuit board 21 for being assembled vertically to the rear of the insert 20, and a footer 22 having an insulative body 25 and a plurality of terminals 26 molded in the insulative body 25 for being connected to the printed circuit board 21 from the rear. The printed circuit board 21 defines two rows of staggered plated through holes 27 in both upper and lower portions thereof. The two rows of staggered through holes 27 in the upper portion are vertically symmetric with those in the lower portion. Each plated through hole 27 is electrically connected to a vertically aligned through hole 27 via a conductive trace 28 therebetween. Each contact 24 of the insert 20 includes a downwardly and rearwardly bent mating portion 241 for mating with a corresponding contact of the complementary plug connector, a tail portion in the form of a press-fit eyelet portion 243 for being press fitted into a corresponding through hole 27 in the upper portion of the printed circuit board 21, and an intermediate portion 242 (also see FIGS. 4 and 5) substantially insert molded in the insulative body 23. Each terminal 26 of the footer 22 also includes a press-fit eyelet portion 261 for being press fitted into a corresponding through hole 27 in the lower portion of the printed circuit board 21, a downwardly bent tail portion 262 for being inserted through a corresponding through hole of a mother board (not shown), and an intermediate portion (not shown) insert molded in the insulative body 25.

As described above, by the arrangement of the insert module 2, an electrical path is established between the complementary plug connector and the mother board through the contacts 24 of the insert 20, the plated through holes 27 and the conductive traces 28 of the printed circuit board 21, and the terminals 26 of the footer 22. Due to the provision of the press-fit eyelet portions 243 and 261 of the respective contacts 24 and terminals 26, assembly and disassembly of the insert module 2 is significantly facilitated since no soldering is required. In addition, the press-fit engagement also allows ready replacement of the printed circuit board 21 for repair or upgrade purposes.

Figure 6:
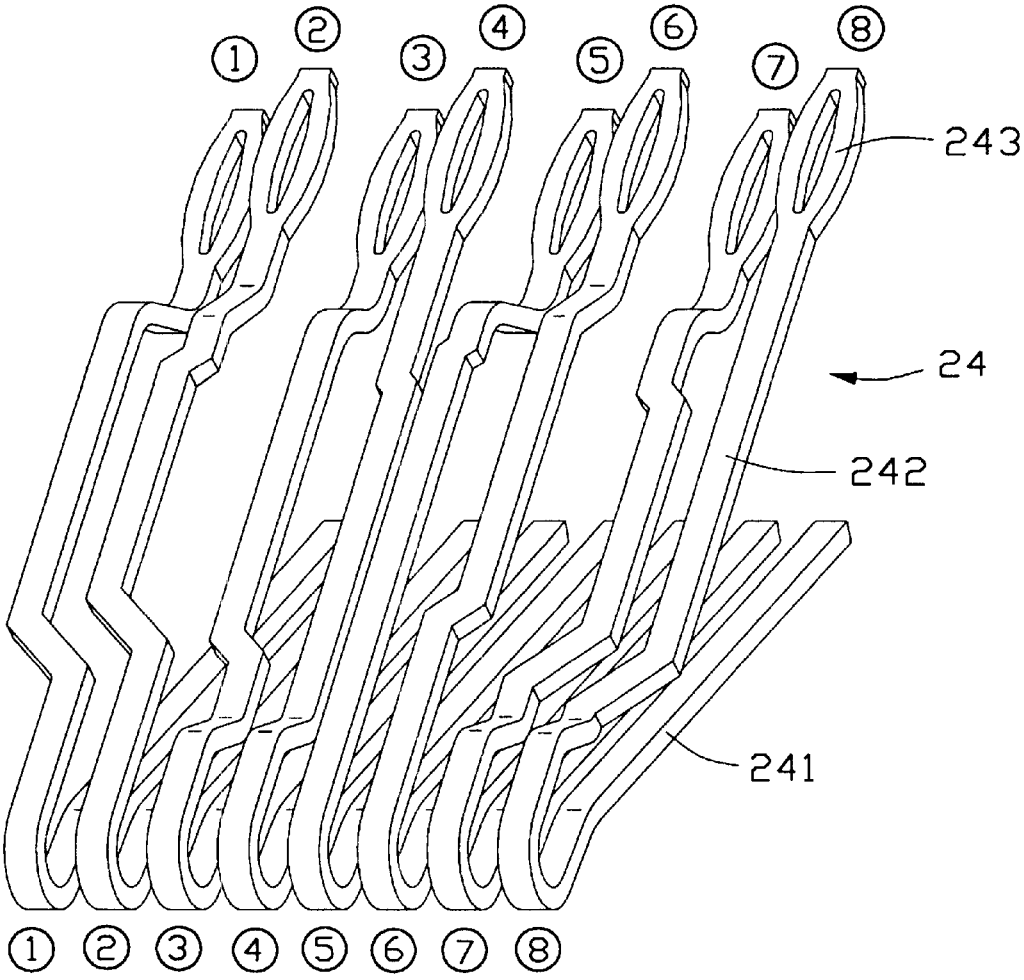
FIG. 6 is a perspective view of the contact array of the present invention.
Figure 7:
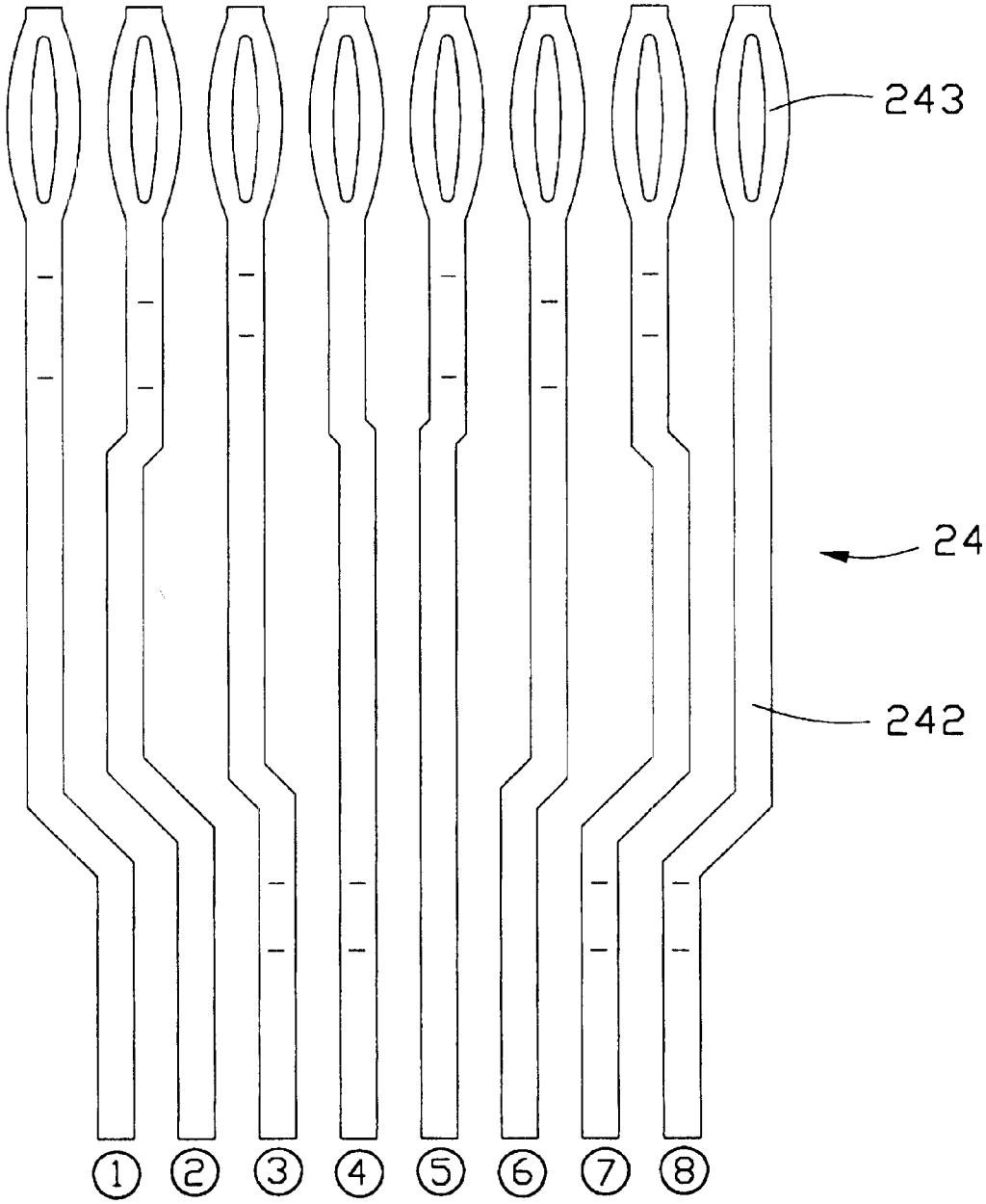
FIG. 7 is a top view of the contact array of the present invention with rearwardly bent mating portions thereof removed for clarity.
Figure 8:
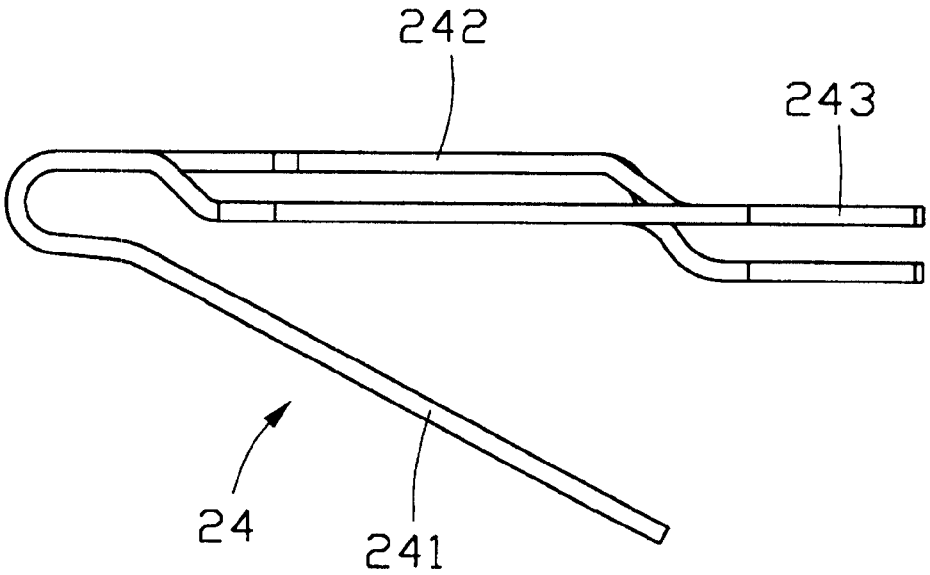
FIG. 8 is a side view of FIG. 6.

The physical arrangement of the contacts 24 of the insert 20 is illustrated in FIGS. 4–8. For facilitating reference, designation numerals ①–⑧ are given to the contacts 24 in the order when viewed from the left side relative to a front end portion of the insert 20. According to the present invention, the contacts 24 are configured as 4 differential pairs having a pairing of ①②-③④-⑤⑥-⑦⑧. As is clearly shown in FIG. 4, the intermediate portions 242 of the contacts 24 are arranged on two levels, wherein those of the ③④ and ⑦⑧ pairs are arranged on a lower level and those of the ①② and ⑤⑥ pairs are arranged on an upper level. To reduce the cross talk induced between the contacts 24 during engagement with the complementary plug connector, the distance between the intermediate portions 242 of each pair is minimized and the distance between adjacent pairs on the same level is maximized. As is illustrated in FIGS. 6 and 7, the front ends of the intermediate portions 242 of the contacts ③, ④, ⑦ and ⑧ proximate the mating portions 241 are upwardly bent, so that the mating portions 241 are maintained in the same plane for facilitating connection with corresponding contacts of the complementary plug connector. The rear ends of the intermediate portions 242 of the contacts ①, ②, ③, ⑤, ⑥ and ⑦ proximate the press-fit eyelet portions 243 are downwardly bent, while the rear ends of the intermediate portions 242 of the contacts ④ and ⑧ are contained in the same plane as the press-fit eyelet portions 243. Thus, all the press-fit eyelet portions 243 have a staggered configuration corresponding to the array of the through holes 27 on the upper portion of the printed circuit board 21. As is clearly shown in FIG. 5, the press-fit eyelet portions 243 are arranged on upper and lower levels, wherein the press-fit eyelet portions 243 of the contacts ②, ④, ⑥ and ⑧ are arranged on the upper level and those of the contacts ①, ③, ⑤ and ⑦ are arranged on the lower level. FIG. 8 illustrates that the press-fit eyelet portions 243 of the contacts ②, ④, ⑥ and ⑧ are arranged on the same level as the intermediate portions 242 of the contacts ③, ④, ⑦ and ⑧ for reducing the profile of the insert 20.

FIG. 9 is a table illustrating the electrical contact arrangement of the present invention, which allows Category 5 electrical performance in a copper wire network optimized for 1000Base-T applications. The contacts 24 in accordance with the present invention, as is shown in FIGS. 6–8, are grouped as 4 differential pairs all used for transmitting and receiving signals, wherein ①② is a first pair for signal transmission, ③④ is a is a second pair for signal transmission, ⑤⑥ is a third pair for signal reception and ⑦⑧ is a fourth pair for signal reception. The two contacts 24 of each differential pair carry the same signals, 180 degrees out of phases, wherein one is (+) plus, and the other is (−) minus.

As is well known in the art, improving cross talk performance of the modular jack connectors and plug connectors is a very important concern to allow existing copper cable systems to compete with optical fiber networks. However, characteristics inherent to the existing modular jack connector interface, tend to limit the amount of cross talk reduction that can be achieved when using the connectors with copper cable systems. It would therefore be desirable to provide a modular jack connector for 1000Base-T applications that excels in cross talk performance relative to current modular jack connector designs. 1000Base-T protocol requires NEXT cross talk of <−40 dB at 100 MHz between all four contact pairs of the modular jack connector. To meet such a requirement, the present invention provides a new contact array design as illustrated in FIGS. 4–8. The contacts 24 of the present invention are repositioned as four differential pairs as far apart as possible within the outline of the insulative body 23 of the insert 2.

The present invention meets the aforesaid electrical performance for 1000Base-T applications due to the following reasons.

Firstly, contrary to the conventional contact arrangement for a modular jack connector having a pairing of ①②-③⑥-④⑤-⑦⑧ with only two pairs ①② and ③⑥ used for signal transmission and reception, the contacts 24 of the present invention have a pairing of ①②-③④-⑤⑥-⑦⑧ with all four differential pairs used for signal transmission and reception. Such a novel contact arrangement ensures a vast increase in exchanged data up to 250 Mbps transmission rate since all four pairs of the contacts are used.

Secondly, no contact shifting or crossing over is involved in the present invention, which is contrary to the conventional design that will severely and negatively impact the electrical performance for 1000Base-T applications.

Thirdly, each differential pair of the contacts 24 of the present invention transmits equal but opposite signals that correspondingly generate equal but opposite fields. These equal and opposite fields cancel each other with the result that little cross talk occurs between each differential pair and other adjacent contacts 24.

Fourthly, the distance within each differential pair of the contacts 24 of the present invention is minimized and the distance between adjacent pairs on the same level is maximized, thereby further reducing the cross talk induced between the contacts 24 during engagement with the complementary plug connector.

Finally, the printed circuit board 21, which functions as a cross talk compensating printed circuit board, also helps to achieve the electrical performance for 1000Base-T applications. The printed circuit board 21 isolates the same differential pairs, and adds inter-digital compensation to significantly balance the electrical performance within the pair for overall optimized connector performance. To optimize the connector performance, damping components, such as capacitors or coils for suppressing high voltage, resistors for filtering termination, and filters for filtering interferential signal communication resulting from the high frequency characteristics of the connector, may be added to the printed circuit board 21.

Category 5 performance and 1000Base-T specifications require the cross talk induced between contact pairs be less than minus forty dB (−40 dB) at 100 MHz. From the table of FIG. 10, it can be seen that the near end cross talk induced between contact pairs of the present invention is dramatically reduced. The analysis results actually show high Category 5E performance, with Category 6 numbers on most lines. This mainly results from the novel contact arrangement of the present invention. It should be noted that since the contact array of the present invention is symmetrical in design, only the analysis of the pairs illustrated in FIG. 10 is needed.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for mating with a complementary connector comprising an insulative body and a plurality of contacts retained in the insulative body, each of said plurality of contacts including a mating portion for mating with a corresponding contact of the complementary connector, a tail portion for being connected to a mother board on which the connector is mounted, and an intermediate portion between the mating portion and the tail portion, said plurality of contacts comprising four pairs of contacts sequentially retained in the insulative body, each of said pairs having a first contact and a second contact, the intermediate portions of the first and second contacts of a first one and a third one of said pairs being retained in the insulative body on an upper level, the intermediate portions of the first and second contacts of a second one and a fourth one of said pairs being retained in the insulative body on a lower level spaced from said upper level.

2. The electrical connector as described in claim 1, wherein each of said pairs of contacts is a differential pair transmitting or receiving equal but opposite signals.

3. The electrical connector as described in claim 2, wherein the first and second one of said pairs of contacts transmit signals, and the third and fourth one of said pairs of contacts receive signals.

4. The electrical connector as described in claim 1, wherein the distance between the intermediate portions of the first and second contacts of each pair is smaller than the distance between the adjacent pairs on the same level.

5. The electrical connector as described in claim 1, wherein the mating portions of the contacts extend from the intermediate portions at an acute angle.

6. The electrical connector as described in claim 1, wherein the tail portions of the contacts are configured as press-fit eyelet portions in an alternating, staggered manner.

7. An electrical connector for mating with a complementary connector comprising an insulative body and a plurality of contacts retained in the insulative body, each of said plurality of contacts including a mating portion for mating with a corresponding contact of the complementary connector, a tail portion for being connected to a mother board on which the connector is mounted, and an intermediate portion between the mating portion and the tail portion, said plurality of contacts comprising two pairs of contacts, each of said two pairs having a first contact and a second contact, the intermediate portions of the first and second contacts of one pair being retained in the insulative body on an upper level, the intermediate portions of the first and second contacts of the other pair being retained in the insulative body on a lower level spaced from said upper level, the tail portions of the contacts of the two pairs being arranged in an alternating, staggered manner.

8. The electrical connector as described in claim 7, wherein the contacts of said one pair transmit signals, and the contacts of the other pair receive signals.

9. The electrical connector as described in claim 7, wherein the tail portions of the contacts of the two pairs are arranged on two levels, one of said two levels being coplanar with said lower level on which the intermediate portions of the first and second contacts of the other pair of said two pairs are retained.

10. The electrical connector as described in claim 7, wherein the tail portions of the contacts are configured as press-fit eyelet portions.

11. An electrical connector for mating with a complementary connector comprising an insulative body having a front endportion adapted for engaging with the complementary connector, and a plurality of contacts retained in the insulative body, said plurality of contacts having eight spaced contacts arranged in the order when viewed from a left side of said front end portion of the insulative body, wherein contacts 1 and 2, contacts 3 and 4, contacts 5 and 6, and contacts 7 and 8 respectively form first, second, third and fourth differential pairs for transmitting or receiving equal but opposite signals, the first and second differential pairs transmitting signals and the third and fourth differential pairs receiving signals, wherein said first and third differential pairs of contacts are arranged on an upper level, and said second and fourth differential pairs of contacts are arranged on a lower level spaced from said upper level, wherein tail portions of the contacts are configured as press-fit eyelet portions and are arranged in an alternating, staggered manner.

12. A modular jack connector for interconnecting a complementary plug connector with a mother board on which the modular jack connector is mounted, comprising:

an insulative housing defining a cavity therein for receiving a complementary plug connector; and an insert module retained in the insulative housing, said insert module comprising an insert retaining a plurality of contacts therein, a printed circuit board having an upper array and a lower array of plated through holes electrically connected with each other by conductive traces therebetween, and a footer retaining a plurality of terminals therein, said contacts of the insert having front mating portions extending into the cavity of the insulative housing for mating with corresponding contacts of the complementary plug connector, intermediate portions retained in an insulative body of the insert, and rear press-fit eyelet portions press fitted into the upper array of plated through holes of the printed circuit board, said terminals of the footer having front press-fit eyelet portions press fitted into the lower array of corresponding plated through holes of the printed circuit board, and rear tail portions for being connected with a mother board, whereby an electrical path is established within the insert module through the contacts of the insert, the plated through holes and conductive traces of the printed circuit board and the terminals of the footer, wherein said contacts of the insert comprises four pairs of contacts sequentially retained in the insulative body, the intermediate portions of the contacts of a first one and a third one of said pairs being retained in the insulative body on an upper level, the intermediate portions of the contacts of a second one and a fourth one of said pairs being retained in the insulative body on a lower level spaced from said upper level, wherein rear press fit eyelet portions of the contacts are arranged on two levels, one of said two levels being coplanar with said lower level on which the intermediate portions of the contacts of the second one and the fourth one of said pairs are retained and wherein the printed circuit board is a cross talk compensating circuit board with inter-digital compensation added for optimized electrical performance.

* * * * *